United States Patent [19]

Asakawa et al.

[11] 4,159,399

[45] Jun. 26, 1979

[54] SECURITY COMMUNICATION SYSTEM USING POLARITY INVERSION

[75] Inventors: Shigeru Asakawa, Fujisawa; Fumio Sugiyama, Yokohama; Makoto Nakamura, Miura; Tsukasa Okai, Yokohama, all of Japan

[73] Assignee: Tokyo Shibaura Electric Co., Ltd., Kawasaki, Japan

[21] Appl. No.: 837,768

[22] Filed: Sep. 29, 1977

[30] Foreign Application Priority Data

| | | | |
|---|---|---|---|
| Sep. 29, 1976 | [JP] | Japan | 51-116051 |
| Nov. 5, 1976 | [JP] | Japan | 51-132884 |
| Nov. 5, 1976 | [JP] | Japan | 51-132885 |

[51] Int. Cl.[2] ..... H04K 1/02; H04K 1/08

[52] U.S. Cl. ..... 179/1.5 E; 179/1.5 R

[58] Field of Search ..... 179/1.5 R, 1.5 E; 178/22

[56] References Cited

U.S. PATENT DOCUMENTS

| | | | |
|---|---|---|---|
| 3,180,927 | 4/1965 | Heppe et al. | 179/1.5 R |
| 3,723,878 | 3/1973 | Miller | 179/1.5 R |
| 3,740,477 | 6/1973 | Switsen | 179/1.5 R |
| 3,824,468 | 7/1974 | Zegers | 179/1.5 R |
| 3,893,031 | 7/1975 | Majeau et al. | 179/1.5 R |
| 3,909,534 | 9/1975 | Majeau et al. | 179/1.5 R |

*Primary Examiner*—Howard A. Birmiel
*Attorney, Agent, or Firm*—Flynn & Frishauf

[57] ABSTRACT

In a security communication system, the transmitting unit includes a sample - hold circuit for sampling and holding the original voice signal, an inverting circuit for inverting the polarity of the samples of the voice signal in accordance with a first code, an adder circuit for adding a D.C. signal to the output signal of the inverting circuit, and another inverting circuit for inverting the polarity of the samples of the output signal of the adder circuit in accordance with a second code. The receiving unit includes a sample - hold circuit for sampling and holding the received signal, a synchronizing circuit for extracting a synchronizing signal component from a received signal during, for example a period of non-voice transmission, and for synchronizing the transmitting unit with the receiving unit, an inverting circuit for inverting the polarity of the samples of the received signal in accordance with the second code, a circuit for removing a D.C. signal component from the output of the inverting circuit, and a polarity inverting circuit for restoring the received signal from which the D.C. signal has been removed by said removing circuit to the original voice signal through the polarity inversion of the received signal in accordance with a third code.

15 Claims, 15 Drawing Figures

SECURITY COMMUNICATION SYSTEM USING POLARITY INVERSION

BACKGROUND OF THE INVENTION

The present invention relates to a security communication system and, more particularly, a communication system which can keep the communication secret from eavesdroppers with the same kind communication apparatus.

Generally, in communication systems except radio broadcasting systems or the like, it is desirable that communication is performed only between or among related parties. Particularly, in communications in which monitoring of a third party is undesirable, such as for example those by police radios and those including top secrets of nations, keeping the communications secret is very a important matter. Nevertheless, conventional communication systems of this kind permit third parties other than related persons to relatively easily monitor the communication. Diverse means to avoid such monitoring by unrelated persons have been developed and practiced; however, none of them have satisfactorily succeeded. Enhancement of the security of the communication needed a complex communication method. This results in complex circuits with a large number of parts, being accompanied by large size and high cost.

SUMMARY OF THE INVENTION

A principal object of the present invention is to provide a security communication system in which the security of communication is perfectly kept and in which monitoring by third parties can be completely prevented except for parties with specified transmitting and receiving sets.

Another object of the present invention is to provide a security communication apparatus which does not need special communication methods and can be constructed with simple circuits, so that the security communication apparatus can be compact in size and low in cost.

A further object of the present invention is to provide a security communication system which can smoothly establish a synchronization between the transmitting side and the receiving side.

According to one embodiment of the present invention, there is provided a security communication system having a transmitting unit in which an original signal and a D.C. signal component to be superposed on the original signal are inverted in polarity in accordance with a given code and wherein these signals are added to each other and the added signals then transmitted. A receiving unit is provided in which the signal transmitted from the transmitting unit is received, and the received signal is reproduced to the original signal by inverting the polarity of the received signal in accordance with a given code and removing the D.C. signal component from the received signal. The transmitting unit comprises: a first polarity inverting circuit for inverting the polarity of the samples of the original signal in accordance with a first code (S1); an adder circuit for adding an output of the first polarity inverting circuit to the D.C. signal; a second polarity inverting circuit which is connected to the adder circuit, and inverts the polarity of the samples of an output signal of the adder circuit in accordance with a second code (S2); and a low pass filter which is connected to the second polarity inverting circuit and transmits the filtered signal to a transmitter.

The receiving unit comprises: a synchronizing circuit for detecting a synchronizing signal component from the signal transmitted from the transmitting unit and establishing a synchronization between the transmitting side and receiving side; a third polarity inverting circuit for inverting the polarity of the samples of the received signal in accordance with the second code synchronizing to a detected synchronizing signal component; a D.C. signal component removing circuit which is connected to the third polarity inverting circuit and which removes the D.C. signal component from an output signal of the third polarity inverting circuit; and a fourth polarity inverting circuit which is connected to the D.C. signal removing circuit and inverts the polarity of the samples of an output signal of the D.C. signal removing circuit in accordance with the first code.

One of important features resides in that an original signal and a D.C. signal to be superposed on the original signal are used and, depending on the combination of the superposition of both signals, the original signal is scrambled in accordance with a given code. When the original signal being used in communication is a voice signal, it necessarily includes periods where the voice interrupts, i.e. non-voice periods. The non-voice periods occupy approximately half of the entire time length of the voice signal. The synchronization is established between the transmitting side and the receiving side by using a synchronizing signal extracted from the non-voice periods of the received signal.

Other objects and features of the present invention will be apparent from the following description taken in connection with the accompanying drawings, in which:

DETAILED DESCRIPTION OF THE PREFERRED EMBODIMENTS

Figure 1:
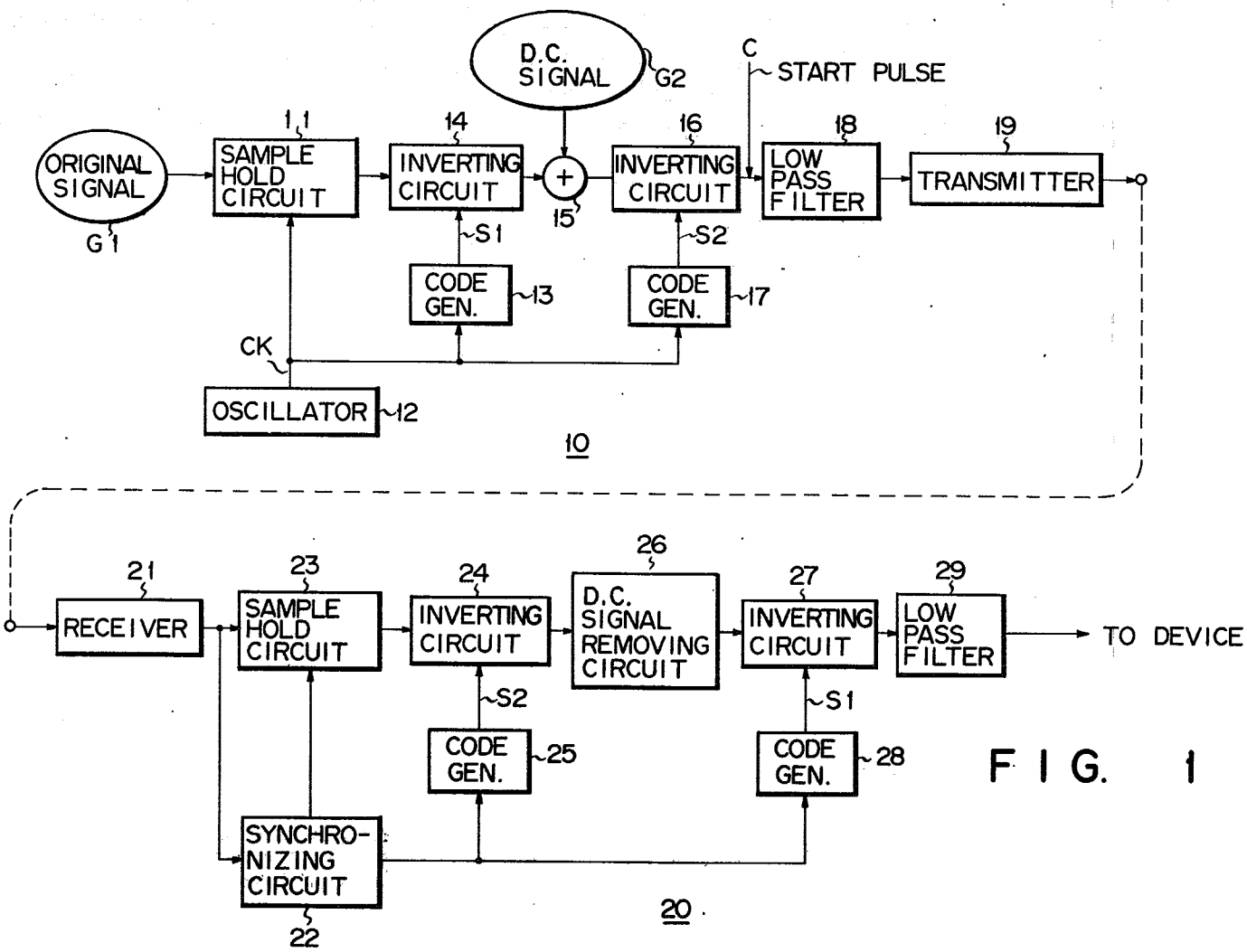
FIG. 1 shows a block diagram of an embodiment of a security communication system according to the present invention.

Referring now to FIG. 1, there is shown a security communication system including a transmitting unit 10 in which an original signal and a D.C. signal are added and the samples of the added signal are inverted in polarity in accordance with a given code and then the polarity inverted signal is transmitted. A receiving unit 20 which receives the signal transmitted from the transmitting unit, inverts the polarity of the samples of the received signal in accordance with a given code, and removes the D.C. signal component from the received signal to convert the received signal to said original signal.

Figure 2:
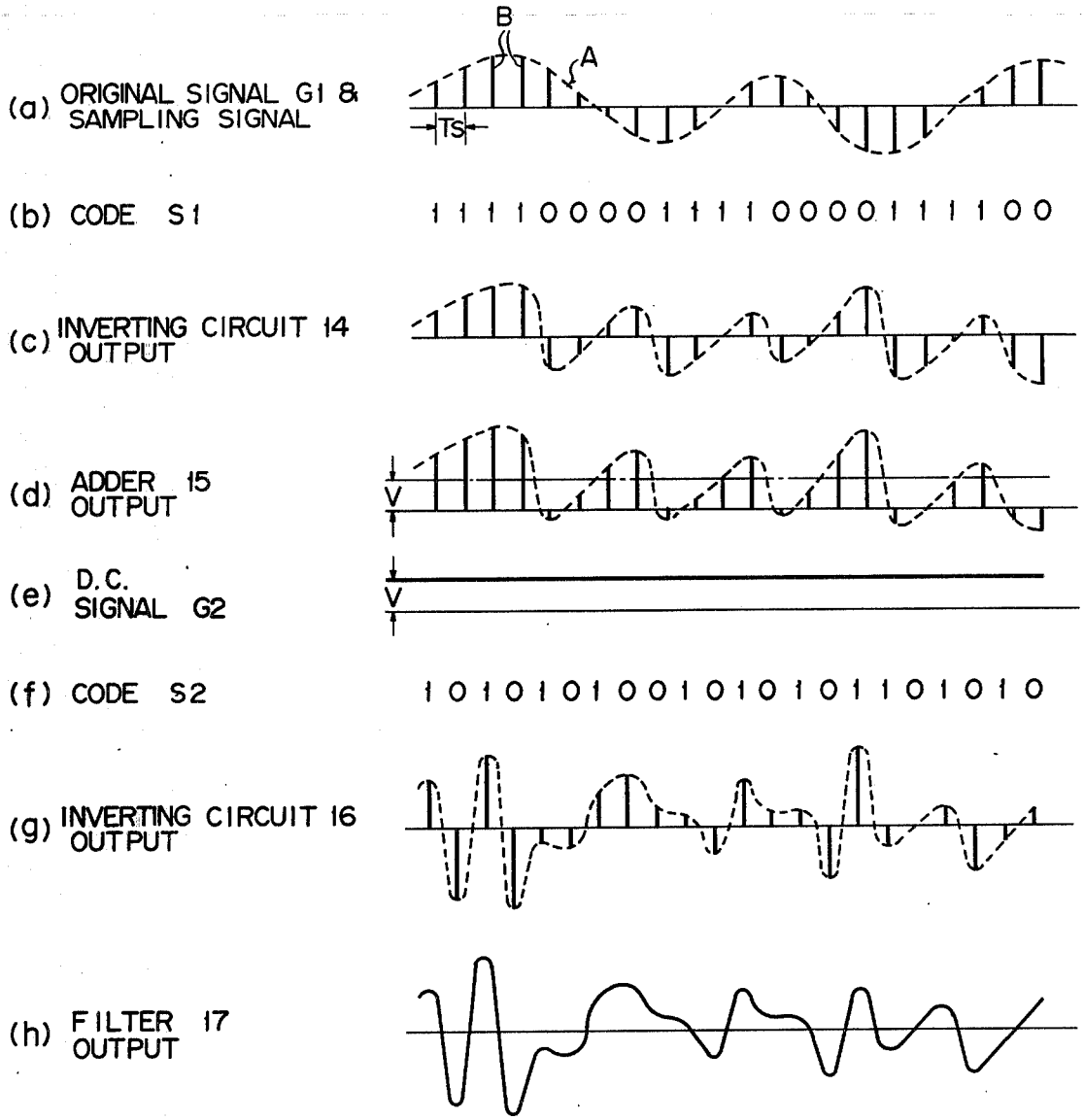
FIG. 2 shows a set of waveforms for illustrating the operation of the security communication system of FIG. 1.

An original signal G1 fed to the input of the transmitting unit 10 is, for example, a voice signal including signal components within a limited frequency band, as indicated by a broken line A in FIG. 2(*a*). The original signal G1 is applied to a sample-hold circuit 11. The sample-hold circuit 11 successively samples the original signal G1 by clock signals CK to be described later at the sampling period Ts to produce a signal as indicated by the continuous lines B in FIG. 2(*a*). An oscillator 12 generates, for example, the clock signal CK of 4,800 Hz as a reference signal which in turn is fed to the sample-hold circuit 11 and code generators 13 and 17. A first polarity inverting circuit 14 is connected to the output terminal of the sample-hold circuit 11, and inverts the polarity of the samples of the original signal G1 in accordance with a polarity inverting code S1 supplied from the code generator 13. The code generator 13 produces the polarity inverting code S1 in accordance with the clock signal fed from the oscillator 12. The code S1 is comprised of 8 bits per frame code (11110000), for example, as shown in FIG. 2(*b*), synchronizing to the sampling period Ts in the sample-hold circuit.

Figure 3:
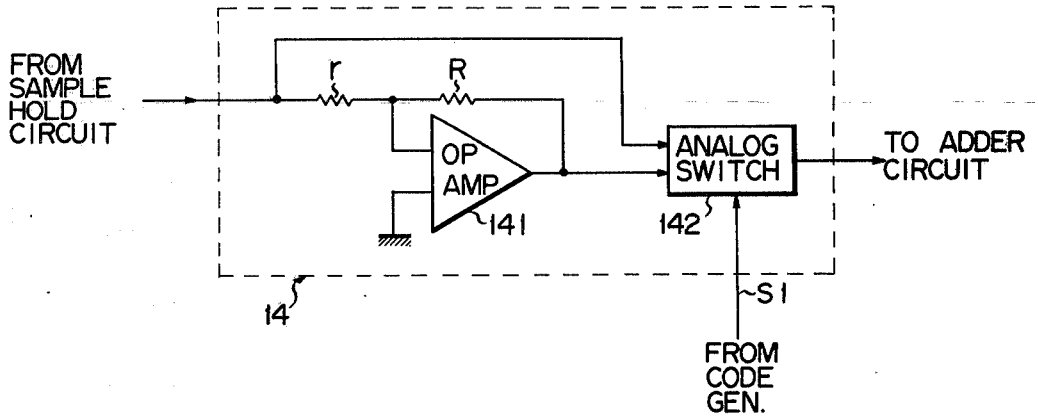
FIG. 3 shows a circuit diagram of a polarity inverting circuit shown in FIG. 1.

FIG. 3 shows the details of the polarity inverting circuit 14. The polarity inverting circuit includes an inverting operational amplifier 141 which amplifies the signal fed from the sample-hold circuit and inverts the polarity of the samples the signal, and analogue switch 142 which switches between the output of the sample-hold circuit 11 and the output of the amplifier 14 in response to the logical level of the code S1 fed from the code generator 13. The analogue switch 142 operates in such a manner that, when the code S1 is "0" in logical level, the output of the sample-hold circuit 11 is permitted to feed through to the adder circuit 15 (FIG. 1), while when it is "1," the output signal of the amplifier 141 is caused to feed the adder circuit 15. Accordingly, the polarity inverting circuit 14 inverts the polarity of the samples of the original signal when the logic level of code S1 is "0" to produce a signal as shown in FIG. 2(*c*).

The signal of which the polarity is inverted in accordance with the code S1 in the inverting circuit 14 is fed to the adder 15. The adder 15 superposes a D.C. voltage signal G2 with DC bias level V as shown in FIG. 2(*e*), for example, on the output of the inverting circuit 14 shown in FIG. 2(*c*) to produce a signal as shown in FIG. 2(*d*). The output of the adder 15 is coupled to a second polarity inverting circuit 16. The second polarity inverting circuit 16 inverts the polarity of the samples of the input signal thereto in accordance with a polarity inverting code S2 outputted from a code generator 17. The construction of the polarity inverting circuit 16 is the same that of FIG. 3. The code generator 17 operates in response to the clock signal CK fed from the oscillator 12, and produces the polarity inverting code S2 synchronizing to the polarity inverting code S1. The polarity inverting code S2 is a 16 bit code (1010101001010101) as shown in FIG. 2(*f*). When the code S2 is logical "0," the inverting circuit 16 inverts the polarity of the samples of the input signal thereto and produces it. The signal of which the polarity of the samples is inverted in accordance with the code S2 is shown in FIG. 2(*g*). A low-pass filter 18 connected to the second polarity inverting circuit 16 filters the polarity inverted signal of FIG. 2(*g*), as shown in FIG. 2(*h*), and couples the filtered signal to a transmitter 19.

In the transmitter 19, the output signal of the filter 18 is properly modulated into a signal mode suitable for the transmission line, through modulation multiplication and the like. In this way, the original signal indicated by a broken line A in FIG. 2(*a*) is converted into the signal as shown in FIG. 2(*h*), and the converted signal of FIG. 2(*h*) is then transmitted. As seen from a comparison of these signals, the information of the FIG. 2(*a*) original signal is completely scrambled in the FIG. 2(*h*) signal.

Figure 4:
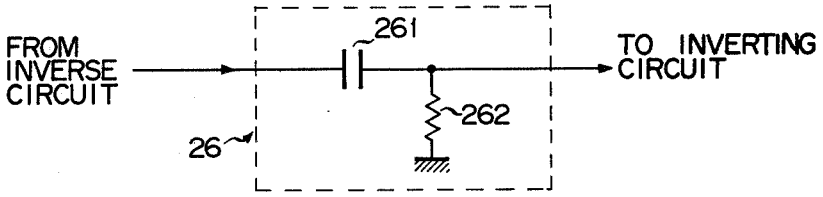
FIG. 4 shows a circuit diagram of a D.C. signal removing circuit shown in FIG. 1.

The receiving unit 20 receives the scrambled signal transmitted from the transmitting unit 10 and reproduces it to the original signal. In the receiver 21, the transmitted signal is demodulated to produce the signal shown in FIG. 2(*h*). The output signal of the receiver 21 is fed to the synchronizing circuit 22 where a synchronizing signal is extracted from the received signal. The synchronizing circuit will be detailed later. The synchronizing signal includes the clock signal with the sampling period in the transmitting unit and a frame synchronizing signal for the codes S1 and S2. The clock signal with the sampling period Ts is supplied to the sample-hold circuit 23. The sample-hold circuit 23 samples the signal received by the receiver 21 in accordance with the sampling synchronizing signal and produces a signal as shown in FIG. 2(*g*). The sample-hold circuit 23 is connected to the third polarity inverting circuit 24. The output signal of the sample-hold circuit 23 is inverted in polarity in accordance with the polarity inverting code generated by the code generator 25. The code generator 25 produces the polarity inverting code S2 which is the same as that of the code generator 17 at the transmitting unit side, in synchronism with the frame synchronizing signal for the inverting codes S1 and S2 extracted by the synchronizing circuit 22. The inverting circuit 24 inverts the polarity of the signal (FIG. 2(*g*)) outputted from the sample-hold circuit 23. The output signal shown in FIG. 2(*d*) of the inverting circuit 24 is led to the D.C. signal component removing circuit 26. The D.C. signal removing circuit 26 is, for example, a filter circuit with a capacitor 261 and a resistor 262, as shown in FIG. 4. The D.C. signal removing circuit 26 may comprise a subtractor or other suitable means. In the circuit 26, the D.C. voltage signal (FIG. 2(*e*)) is removed from the output signal (FIG. 2(*d*)) of the inverting circuit 24 to produce the signal shown in FIG. 2(*c*). The fourth inverting circuit 27 is connected with the D.C. signal removing circuit 26 and inverts the polarity of the signal (FIG. 2(*c*)) in accordance with the polarity inverting code. The code generator 28 produces the polarity inverting code S1 shown in FIG. 2(*b*) depending on the frame synchronizing signal extracted by the synchronizing circuit 22, which code S1 is applied to the inverting circuit 27. The inverting circuit 27 has the same construction as that of the FIG. 3 circuit and inverts the polarity of the input signal thereto when the code S1 is logical "0." The polarity inverted signal is the one indicated by the continuous lines B in FIG. 2(*a*).

This signal is filtered by the low pass filter 29. The output signal (indicated by the broken line A in FIG. 2(*a*)) of the low-pass filter 29 is supplied to a given device not shown. In this manner, the signal (FIG. 2(*h*)) received by the receiver is reproduced to the original signal shown in FIG. 2(*a*). This means that the signal concealed in the transmitting unit 10 is reproduced in the receiving unit 20, permitting the communication of the original signal between the transmitting and receiving sides.

Figure 5:
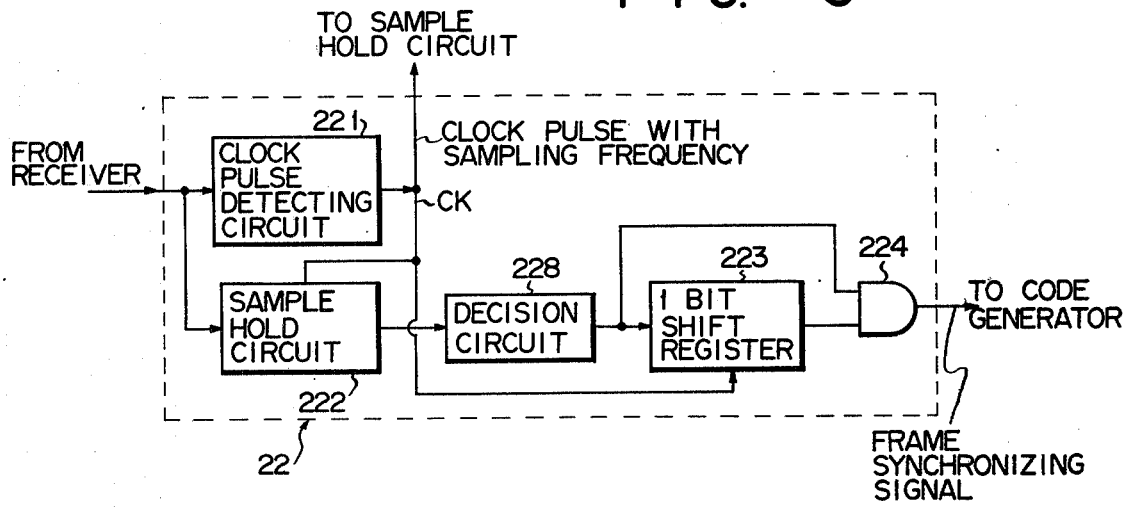
FIG. 5 shows a circuit diagram of a synchronizing circuit of FIG. 1.

The detailed circuit diagram of one embodiment of the synchronizing circuit 22 is shown in FIG. 5. As shown in the figure, the synchronizing circuit 22 includes a clock pulse detecting circuit 221 comprising a digital phase locked loop circuit for detecting the clock pulse with a given sampling frequency from the receiving signal, a sample-hold circuit 222 for sampling the receiving signal by the clock signal with a given sampling frequency, a decision circuit 228 which is connected to the sample-hold circuit 222 and outputs a binary pulse train corresponding to the level of signal derived from the sample-hold circuit 222, a shift register 223 which is connected with the decision circuit 228 and shifts the signal outputted from the circuit 228 by 1-bit, and an AND circuit which multiplies the output signal of the 1-bit shift register and the output signal of the decision circuit 228 to produce the frame synchronizing signal.

The synchronizing circuit 22 serves to extract the synchronizing signal from the receiving signal. When the source signal for communication is a voice signal, almost half of the entire voice period is voice interruption, called the non-voice period. The synchronizing circuit 22 is so designed as to extract the synchronizing signal from the received signal of the non-voice period. During the non-voice period, only the stationary signal shown in FIG. 6(*a*) is inverted in polarity by the second inverting circuit 16 in accordance with the polarity inverting code S2, and then is filtered by the low-pass filter 17. The filtered signal shown in FIG. 6(*c*) is transmitted from the transmitting unit 10. The signal (FIG. 6(*c*)) received by the receiver 21 in the receiving unit 20 is applied to the synchronizing circuit 22 where a clock pulse detecting circuit 221 for discriminating a stationary inverting period of the signal shown in FIG. 6(*c*) detects the sampling period Ts and detects the clock pulse with the sampling frequency shown in FIG. 6(*d*). On the other hand, the received signal of FIG. 6(*c*) is fed to the sample-hold circuit 222 where it is sampled depending on the clock pulse detected by the detecting circuit 221 to be transformed into the signal shown in FIG. 6(*e*) which in turn is outputted from the sample-hold circuit 222. The output signal of FIG. 6(*e*) of the sample-hold circuit 222 is fed to the decision circuit 228 and converted to a binary pulse train. The decision circuit may be constructed in the same manner as the decision circuit of FIG. 15 as later described. An output of the decision circuit 228 is fed to the 1-bit shift register 223 where it is shifted by 1-bit and the shift register 223 outputs the signal shown in FIG. 6(*f*). The output signal of FIG. 6(*f*) of the shift register 223 and the output signal of FIG. 6(*e*) of decision circuit 228 are applied to the AND circuit 224 where they are logically summed to produce the signal of FIG. 6(*g*). As seen from FIG. 6(*g*), this signal is outputted by one per 16 sampling pulses to be the frame synchronizing signal of the polarity inverting code S2. The clock pulse with the sampling period Ts is fed to the sample-hold circuit 23 while the frame synchronizing signal is supplied to the code generators 25 and 28. Accordingly, the code generators 25 and 28 produce the given polarity inverting codes S1 and S2 in response to the frame synchronizing signal. Therefore, the polarity inverting code in the receiving unit 20 is outputted synchronizing to the polarity inverting code in the transmitting unit 10. The clock signal CK with the sampling period Ts of the transmitting unit 10 synchronizes with the clock pulse of the receiving unit 20. Accordingly, a precise synchronization is established between the transmitting and receiving units 10 and 20, in the signal transmission.

Now, it is to be noted that the sample-hold circuit 23 may be used in place of sample-hold circuit 222. In this case, the output signal of circuit 23 may be used instead of the output signal of circuit 222. The clock synchronization is shown, for example, by the digital phase locked loop circuit. When S2 is 10101010, it may be taken by an analogue phased locked loop circuit. When S2 is $$S2 = 1010101001010101 \quad \text{(A)}$$

the circuit of FIG. 5 is used in the synchronization circuit. S2 need not be restricted particularly to this pattern and may take any pattern if a variation point of the frame is known. If, for example, $$S2 = 1100110000110011 \quad \text{(B)}$$

the circuit of FIG. 5 takes a 2-bit shift, not a 1-bit shift, or if, $$S2 = 1111000000001111 \quad \text{(C)}$$

the FIG. 5 circuit takes a 4-bit shift. Even in this case, the clock synchronization, if the phase locked loop is used, can be taken. (For the case of (B) the lock frequency is equal to a $\frac{1}{2}$ lock frequency of (A) and for the case of (C) the lock frequency is equal to a $\frac{1}{8}$ lock frequency, but the phase locked loop circuit can ready produce an n-times lock frequency.) In short the FIG. 5 circuit is one form of synchronization circuit and is determined by code S2.

Figure 8:
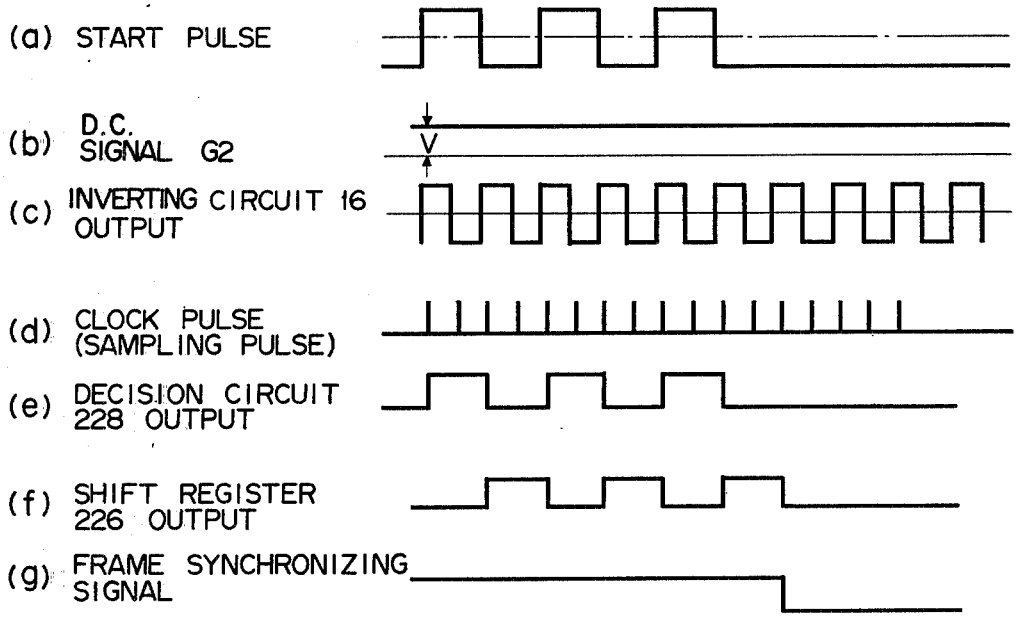
FIG. 8 shows a set of waveforms for illustrating the operation of the FIG. 7 circuit.
Figure 7:
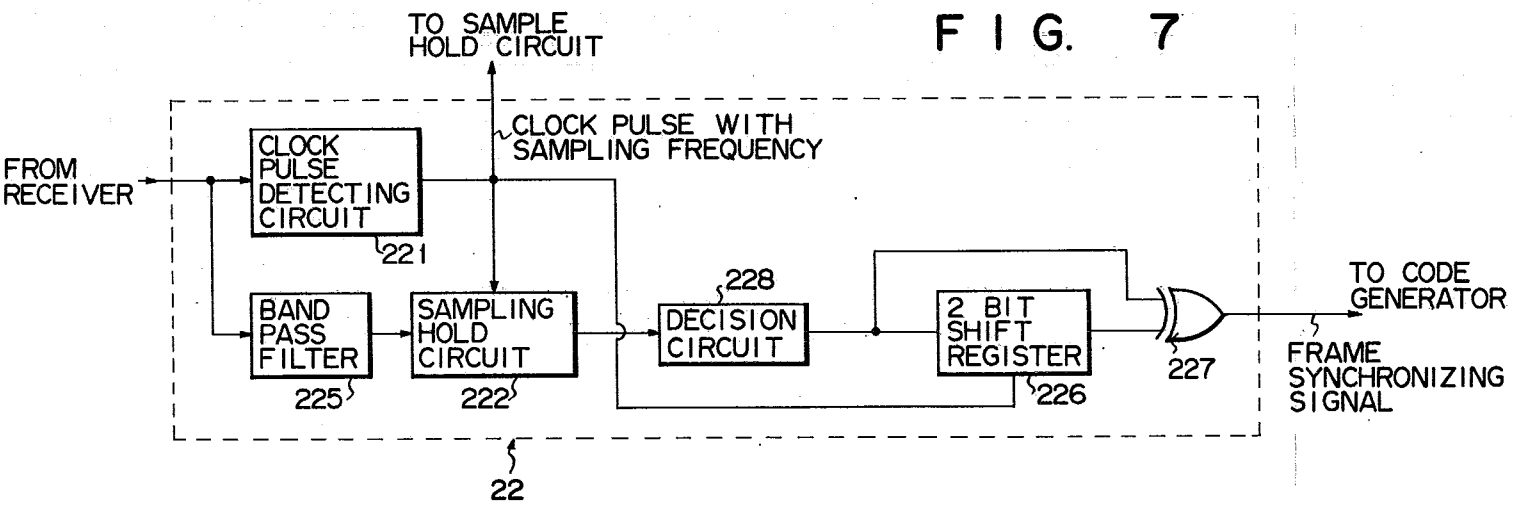
FIG. 7 shows a circuit diagram of another synchronizing circuit shown in FIG. 1.

The synchronizing circuit 22 may be constructed by the circuit shown in FIG. 7. In this case, the transmitting unit 10 transmits a start pulse for establishing the synchronization between the transmitting and the receiving sides (see an arrow C in FIG. 1), for example, a signal with a quarter frequency of the sampling frequency as shown in FIG. 8(*a*), through a filter 18 and a transmitter 19. The start position of frame is decided on the point of time when start pulse transmission is stopped. At the receiving unit 20, the start pulse is detected to make a frame synchronization signal. The synchronization circuit 22 includes a clock pulse detector 221 comprised of a digital phase locked loop circuit for detecting clock pulses with a given sampling period Ts from the receiving signal, a band-pass filter 225 for selecting the start pulse from the received signal, a sample-hold circuit 222 for sampling the output signal of the band-pass filter 25 by the clock pulse, a decision circuit 228 for converting the output signal of the sample-hold circuit 222 to a binary pulse train, a shift register 226 for shifting by 2-bits the output signal of the decision circuit 228, and an exclusive OR circuit 227 which exclusive-ORs the output signal of the shift register 226 and the output signal of the decision circuit 228 to produce a frame synchronizing signal.

In this case, the output signal of the inverting circuit 16 alternately changes between "1" and "0" as shown in FIG. 8(*c*). The clock pulse detecting circuit 221 detects the clock pulses of FIG. 8(*d*) with the sampling period Ts from the receiving signal. The start pulse is filtered with the band-pass filter 225 and fed to the sample-hold circuit 222. The start pulse is sampled by the clock pulse and fed to the decision circuit 228. The decision circuit 228 converts the output signal of sample-hold circuit 222 to the signal shown in FIG. 8(*e*). The output of the decision circuit 228 is applied to the shift register 226 where it is shifted by 2-bits to produce a signal as shown in FIG. 8(*f*). The output signal shown in FIG. 8(*e*) of the decision circuit 228 and the output signal shown in FIG. 8(*f*) of the shift register 226 are fed to the exclusive OR circuit 227 and these signals condition the exclusive OR circuit 227 to produce a frame synchronizing signal, as shown in FIG. 8(*g*). The same thing can also be said with respect to FIG. 7. If a $\frac{1}{8}$ frequency of the sampling frequency is used as a start pulse, shift register 226 permits a 4-bit shift. For a 1/16 frequency, is permits a 8-bit shift.

Figure 6:
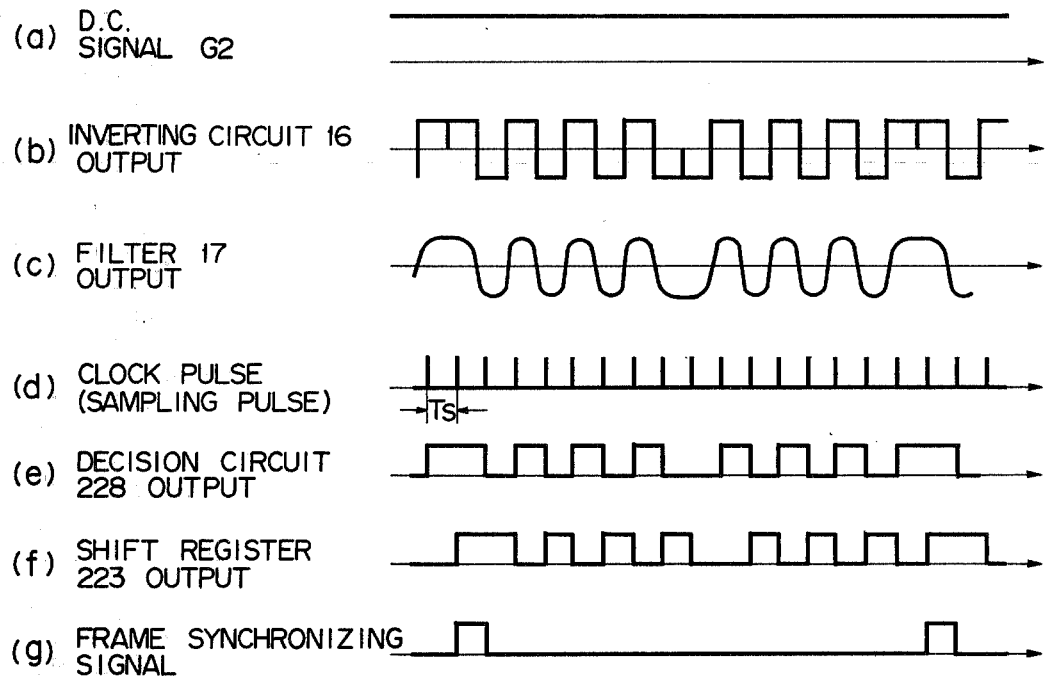
FIG. 6 shows a set of waveforms for illustrating the operation of the FIG. 5 circuit.

The communication system shown in FIG. 1. inverts the polarity of the source signal to be transmitted in accordance with a given code and transmits a signal with a waveform utterly different from that of the source signal, as shown in FIG. 2(*h*). For this, if persons other than the related ones of the communication monitor the signal transmitted, they can not understand the contents of the communication, thus ensuring the secrecy of the communication. An experiment was conducted by the inventors, in which a voice signal was sampled by a signal with 4,800 Hz sampling frequency and the polarity of the signal was inverted by using the polarity inverting codes S1 (11010010) and S2 (1010101001010101). The communication made with such an arrangement was monitored; however, nothing was understood through the monitor. The use of the apparatus of the invention for receiving the communication signal provided good results with clear voice reproduction. That is, the experiment showed that the security communication apparatus satisfactorily protects the security of the communication. In the communication apparatus of the present invention, since the D.C. signal is superposed on the source signal, the sampling period or the frame synchronizing signal may be easily extracted from the D.C. signal component during the non-voice period and the security signal may be reproduced on the basis of the sampled signal. Therefore, unlike the conventional security communication apparatus, there is no need of extracting the synchronizing signal on the basis of a pilot signal inserted outside the frequency band of the source signal and also no need of the insertion of the pilot signal. This simplifies the communication apparatus and thus the apparatus finds wide applications such as in mobile stations. Additionally, in the security communication apparatus, the superposed signal is inverted in the polarity in accordance with the polarity inverting code S2 and the inverted signal is converted into the DC component and then the D.C. signal component is removed by the D.C. signal removing circuit 26. Therefore, if the polarity inverted D.C. signal resides within the frequency band of the voice signal as shown in FIG. 6(*c*), it does not adversely influence the source signal. Further, the polarity inverted D.C. signal depends only on the polarity inverting code S2 in the inverting circuit 16. Consequently, even if an eavesdropper finds a regularity of the polarity inverting code in the D.C. signal, he cannot reproduce the original signal for lack of the knowledge of code S1. As a consequence, the communication apparatus provides an enhanced secrecy of the communication, as compared to the conventional one.

Figure 9:
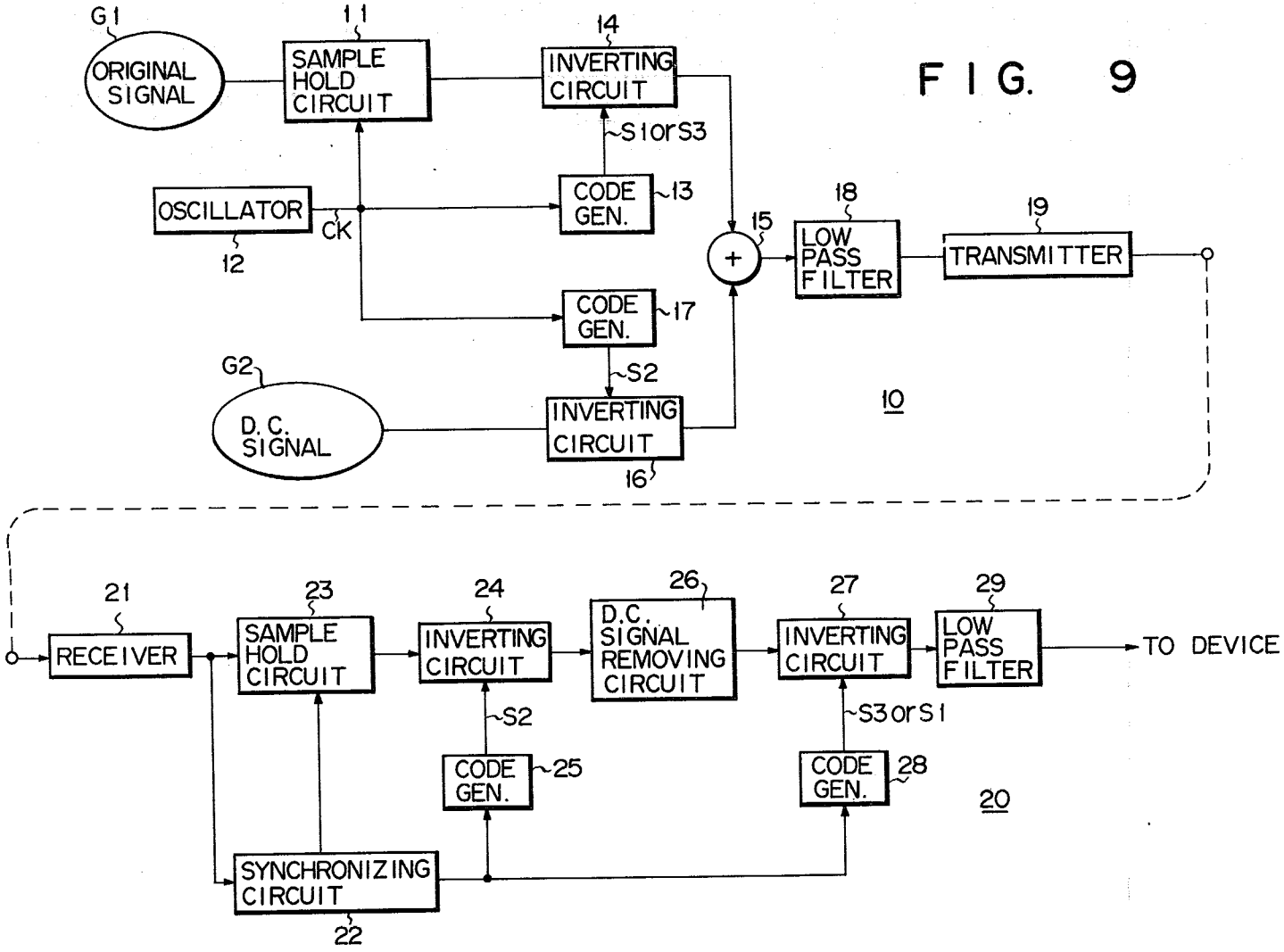
FIG. 9 shows a block diagram of another embodiment of a security communication system according to the present invention.

FIG. 9 shows a block diagram of another embodiment of the security communication system according to the present invention. In this figure, like numerals are used to designate like portions in FIG. 1. The respective circuit blocks are the same as those of FIG. 1 and therefore only the operation of it will be given. In the transmitting unit 10, the source signal G1 which is polarity inverted in accordance with the polarity inverting code generated by the first code generator 13 is added to the D.C. signal G2 of which the polarity is inverted in accordance with the polarity inverting code generated by the second code generator 17 and the resultant signal of the addition is transmitted to the receiving side through a transmitting means.

The original signal G1 to be communicated such as voice signals comprising signal components within a fixed frequency band is indicated by an arrow A. The original signal G1 is successively sampled by the clock signal with the sampling period Ts fed from the oscillator 12, in the sample-hold circuit 11. The sampled signal indicated by an arrow B in FIG. 10(*a*) is supplied to an inverting circuit where it is polarity inverted in accordance with the code signal S1 generated by the code generator 13. The clock signal CK from the oscillator 12 is fed to the code generators 13 and 17. The code generator 13 generates the code S1 (11110000) shown in FIG. 10(*b*); the code generator 17 generates the code S2 (1010101001010101) shown in FIG. 10(*e*). The D.C. signal G2 of the DC level V shown in FIG. 10(*d*) is polarity inverted in accordance with the code S2 in the inverting circuit 16 to be a signal shown in FIG. 10(*f*). The output signal shown in FIG. 10(*f*) from the polarity inverting circuit 16 and the output signal shown in FIG. 10(*c*) from the polarity inverting circuit 14 are summed (superposed) in the adder 15 to produce an addition signal shown in FIG. 10(*g*) and indicated by an arrow B. The output signal of the adder 15 is filtered to be a broken line signal indicated by an arrow A in FIG. 10(*g*) and then is modulated and multiplied by the transmitter 19 to be converted into a signal mode suitable for the transmission line. In other words, the original signal to be transmitted (the broken line signal indicated by the arrow A in FIG. 10(*a*)) is converted into a security signal of broken line indicated by the arrow A in FIG. 4(*g*) and then is transmitted.

Figure 10:
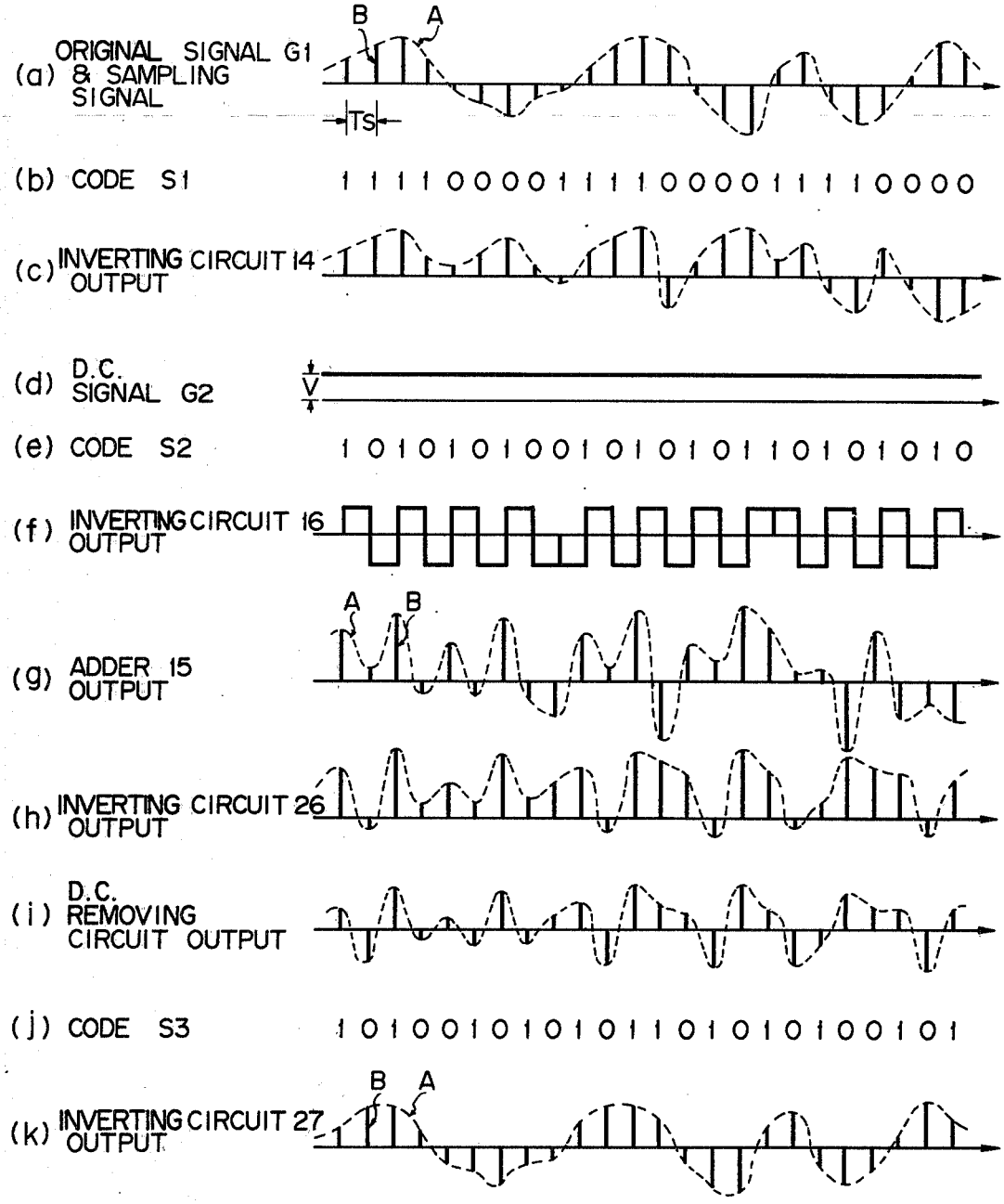
FIG. 10 shows a set of waveforms for illustrating the operation of the FIG. 9 system.

In the receiving unit 20, the signal transmitted from the transmitting unit 10 is received by a receiver 21 where it is subjected to necessary signal process processing such as demodulation to provide the broken line signal indicated by the arrow A in FIG. 10(*g*). The output signal from the receiver 21 is fed to the synchronizing circuit 22 where the clock pulse with the sampling period Ts and the frame synchronizing signal for the codes S1 and S2 are extracted, as in the previous embodiment. The sample-hold circuit 23 samples the received signal depending on the clock signal to produce the sampling signal indicated by the arrow B in FIG. 10(*g*). This sampling signal is fed to the inverting circuit 24 where the polarity thereof is inverted depending on the code S2 shown in FIG. 10(*d*) generated by the code generator 25 to be the signal as shown in FIG. 10(*h*). The polarity inverted signal is fed to the stationary signal removing circuit 26 where the D.C. signal component with DC level V shown in FIG. 10(*d*) is removed to produce the signal shown in FIG. 10(*i*). The output signal of the D.C. signal removing circuit 26 is supplied to the inverting circuit 27. What is supplied to the inverting circuit is the code S3 generated by the code generator depending on the frame synchronizing signal produced in the synchronizing circuit 22. The code S3 is equal to S1⊕S2. The symbol ⊕ denotes a mod.2 addition of the codes S1 and S2, as shown in FIG. 10(*j*). The inverting circuit 27 inverts the polarity of the output signal of the D.C. signal removing circuit 26 on the basis of the code S3. The polarity inverted signal is the one indicated by the arrow B in FIG. 10(*k*) which is filtered by the low-pass filter 29 to be a broken line signal indicated by the arrow A in FIG. 10(*k*). The broken line signal is supplied to an appropriate device not shown. The reproduced signal shown in FIG. 10(*k*) is the same as the original signal shown in FIG. 10(*a*), as will be seen. The reason why the polarity inversion is made in the inverting circuit depending on the code S3 (S1⊕S2) is that the original signal is polarity inverted by the code S1 at the transmitting side and then polarity inverted by the code S2 at the receiving side. The security signal transmitted from the transmitting unit 10 is reproduced at the receiving unit 20 to the original signal, permitting communication with the original signal between the transmitting and receiving sides.

In the security communication system shown in FIG. 9, the polarity inverting circuit 14 for inverting the polarity of the original signal at the transmitting unit may invert the polarity of the signal in accordance with the code S3. In this case, the polarity inverting circuit 27 at the receiving unit executes its polarity inversion on the basis of the code S1. The reason for this is that the original signal G1 of which the polarity is inverted by the code S3 (S1⊕S2) is again polarity inverted by the code S2 in the polarity inverting circuit 25 of the receiving unit and therefore the signal polarity inverted by the code S2 is cancelled. As a consequence, the original signal G1 of which the polarity is inverted by the code S1 is polarity inverted again in accordance with the code S1 by the inverting circuit 27 so that the original signal G1 is restored or reproduced. As seen from the foregoing, the security communication system shown in FIG. 9 attains the same feature and effect as the FIG. 1 system.

Figure 11:
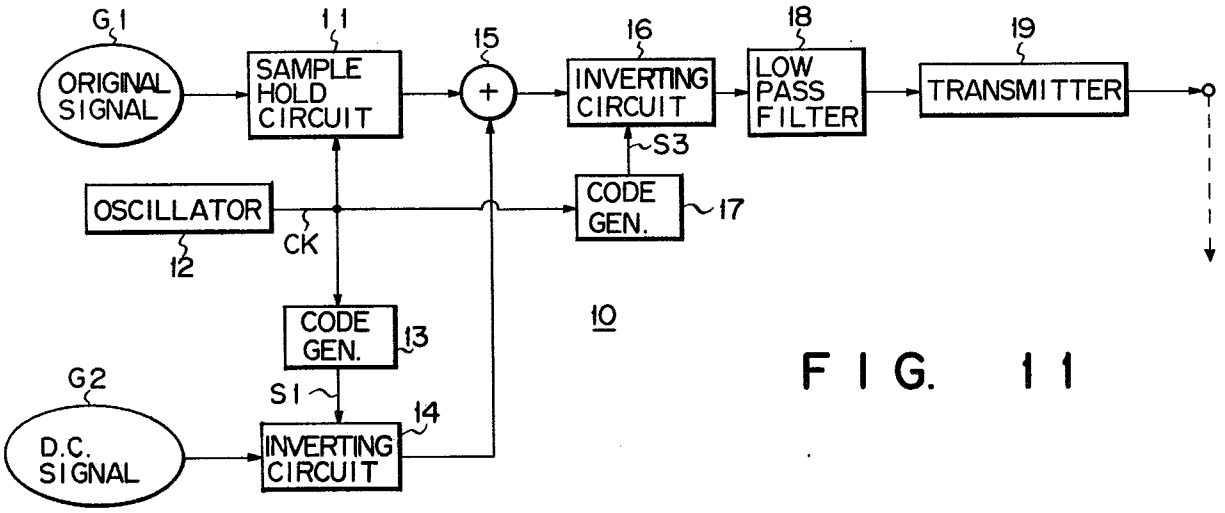
FIG. 11 shows a block diagram of a transmitting unit of a security communication system which is a further embodiment of the present invention.

FIG. 11 shows still another embodiment of the security communication system according to the present invention. In the figure, only the transmitting unit 10 is depicted since the receiving unit 20 is the same as the FIG. 1 receiving unit in construction and operation. In this system, the D.C. signal G2 of which the polarity is inverted on the basis of the code S1 is added to the original signal G1 and then the addition signal is again polarity inverted by using the code S3. Accordingly, the transmitting unit 10 comprises a circuit 11 for sampling the original signal G1, an inverting circuit for inverting the polarity of the D.C. signal G2 on the basis of the code S1 generated by the code generator 13, an adder 15 for summing the output signal of the sampling circuit 11 and the output signal of the inverting circuit 14, an inverting circuit 16 for inverting the polarity of the output signal of the adder 15 on the basis of the code S3 generated by the generator 17, a low-pass filter for filtering the output signal of the inverting circuit 16, and a transmitter 19 for transmitting the output signal of the low-pass filter 18. The clock signals CK generated by the oscillator 12 are applied to the sampling circuit 11, the code generator 13 and the code generator 17.

In the transmitting unit 10, the concealed signal is transmitted from the transmitter 21 like the previously stated embodiments, although the details thereof will not be described. Therefore, the FIG. 11 embodiment attains the same effect as the previous embodiments.

It will be understood that the invention is not limited to the above-mentioned embodiments. The sampling period Ts, the polarity inverting codes S1 and S2, and the like may be properly established complying with the use, specification or the frequency band of the signal for communication. Although, in the above-mentioned embodiments, the original signal is sampled and then the polarity thereof is inverted, the signal of which the polarity is inverted in accordance with a given code may be sampled. For the D.C. signal, a sinuosidal signal with a period of Ts/2, for example, and with a given DC level each sampling timing, may also be used in place of the DC level signal. Further, the polarity inverting code used in the receiving unit 20 may be related in opposition to that of the transmitting unit 10. That is, if the code of the transmitting side is (101010), the code of the receiving side is (010101). In such a case, the phase of the reproduced signal just changes by 180° without any disturbance for the signal restoration.

Figure 12:
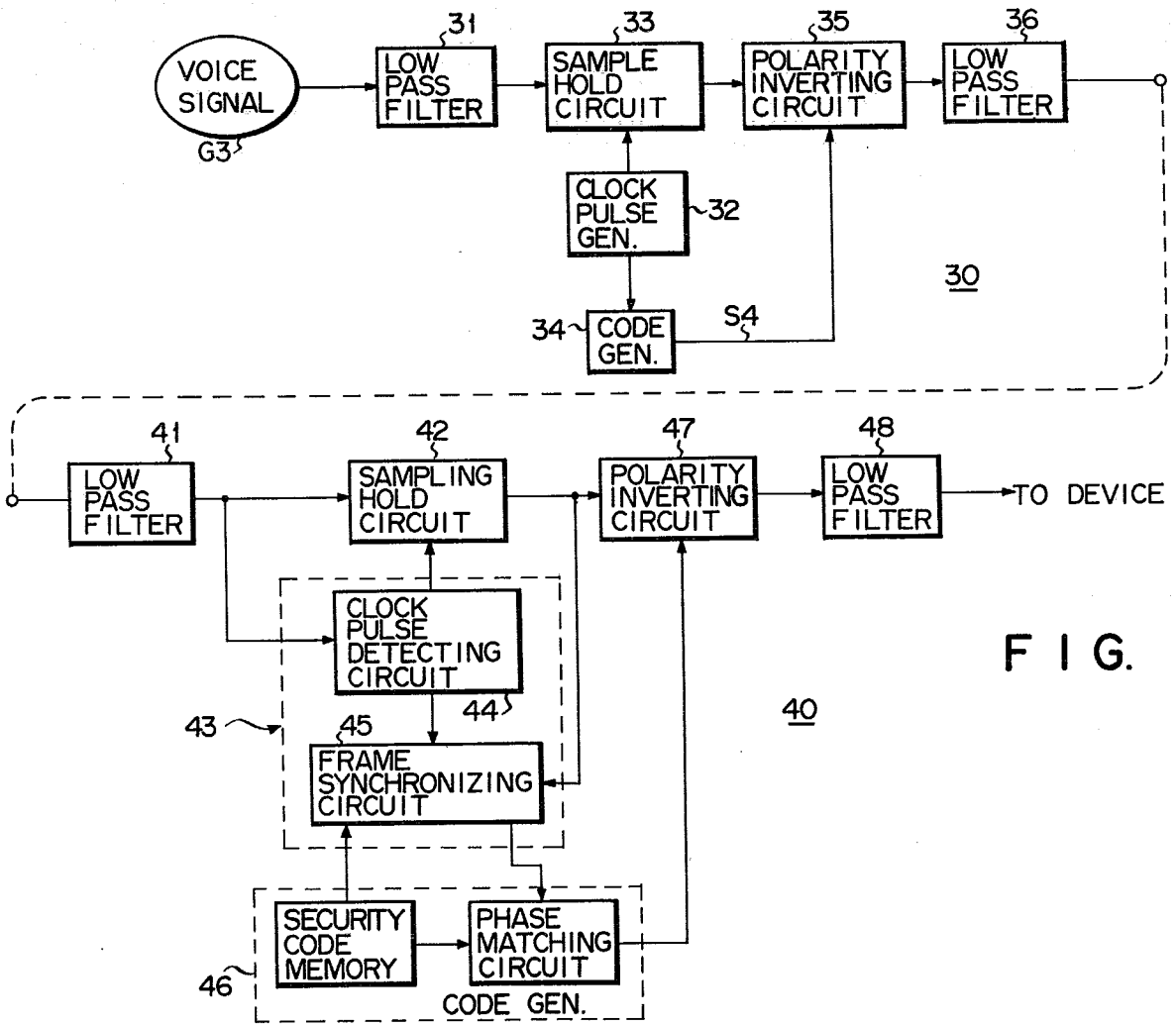
FIG. 12 shows a block diagram of a further embodiment of a security communication system according to the present invention.

FIG. 12 shows yet another embodiment of the security communication system according to the present invention. This embodiment places an emphasis on the precise reproduction of the signal transmitted from the transmitting side. A precise frame synchronization is established in order to the precise reproduction. This frame synchronization is obtained by comparing binary pulse trains of the sampling signal gained from the receiving signal with the security code. In this embodiment, the transmitting side transmits only the voice signal and does not transmit a D.C. signal as in the previous embodiments.

Figure 13:
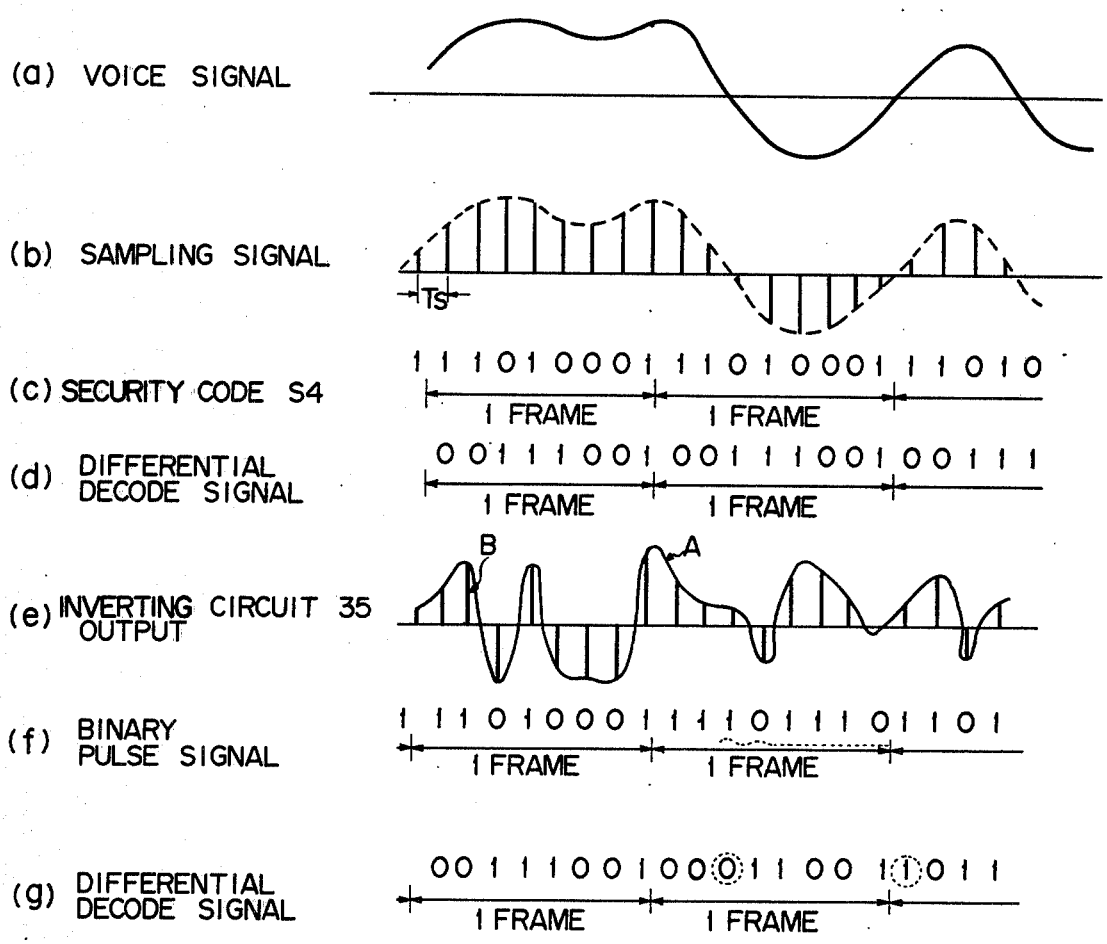
FIG. 13 shows a set of diagrams for illustrating the operation of the FIG. 12 system.

In the transmitting unit 30, the voice signal as shown in FIG. 13(*a*) is obtained from means such as a microphone (not shown). The voice signal is applied to the sample-hold circuit 33 through a low-pass filter 31. The sample-hold circuit 33 receives clock pulses generated from the clock pulse generator 32. The voice signal is sampled by the clock pulse with the sampling period Ts. The sample-hold circuit 33 outputs the sampling signal as shown in FIG. 13(*b*). The security code generator 34 produces a security code S4. e.g. 1 frame=8 bits code (11010001), as shown in FIG. 13(*c*) on the basis of the clock pulses fed from the clock pulse generator 32. The polarity inverting circuit 35 inverts the polarity of the sampling signal shown in FIG. 13(*b*) on the basis of the security code S4. In this case, like the previous embodiments, only when the code S4 is logical "0," the polarity of the sampling signal is inverted, while when it is "1," the sampling signal is not changed in polarity. Accordingly, the inverting circuit 35 outputs a signal indicated by an arrow B in FIG. 13(*e*). The output signal is filtered by the low-pass filter 36 into an enveloped signal indicated by an arrow A in FIG. 13(*e*).

The receiving unit 40 receives achieve the transmitted signal, through the low-pass filter 41 to obtain the enveloped signal indicated by an Arrow A in FIG. 13(*e*). The enveloped signal is fed to the sampling circuit 42 where it is sampled by the clock pulses with sampling period Ts which is detected by the clock pulse detecting circuit 44 in the synchronizing circuit 43, to obtain the sampling signal indicated by an arrow B shown in FIG. 13(*e*). A part of the sampling signal is supplied to the frame synchronizing circuit 45 in the synchronizing circuit 43. The frame synchronizing circuit 45 receives the part of the sampling signal and the clock pulses to produce a frame synchronizing signal. The security code S3 from the code generator 46 which is phase synchronized to the frame synchronizing signal is fed to the polarity inverting circuit 47. The polarity inverting circuit 47 produces a signal as shown in FIG. 13(*b*)by using the security code S4, through polarity inverting the sampling signal indicated by the arrow B in FIG. 13(*e*) in a similar manner. The output of the polarity inverting circuit 47 is filtered by the low-pass filter 48 to be a signal as shown in FIG. 13(*a*). Accordingly, in the receiving unit 40, the voice signal transmitted from the transmitting unit 30 may be restored, by only the receiving unit knowing the security code to communicate with the transmitting unit.

Figure 14:
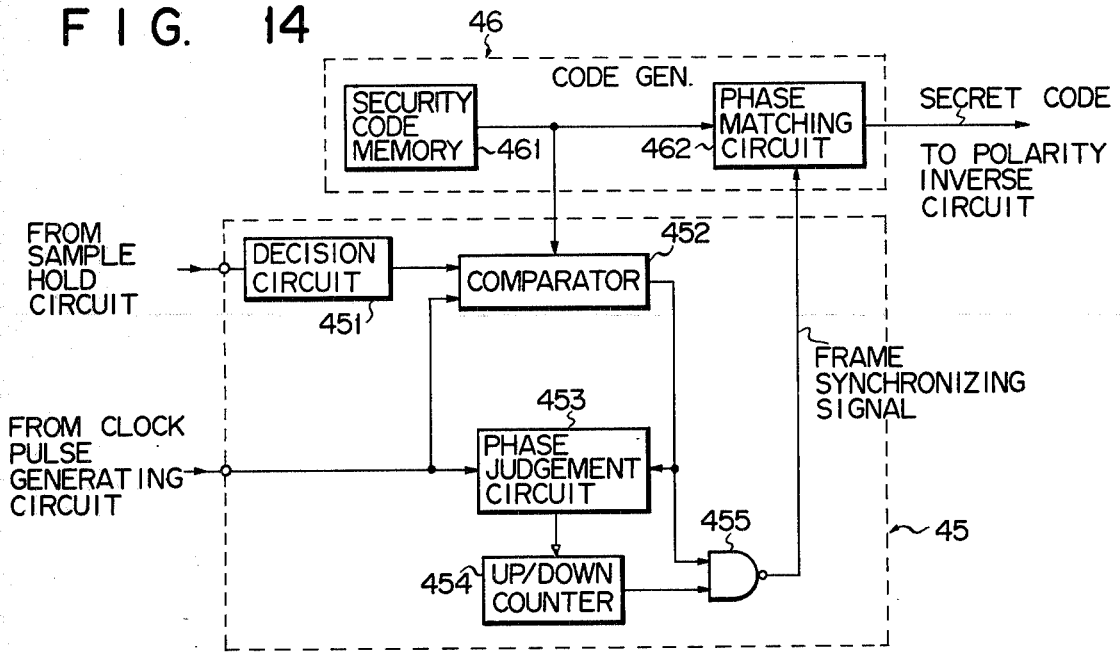
FIG. 14 shows a circuit diagram of a synchronizing circuit used in the FIG. 12 system.

The synchronizing circuit 43 includes a clock pulse detection circuit 44 comprised of a digital phase locked loop circuit for detecting the clock pulses with the sampling period Ts from the receiving signal, and a frame synchronizing circuit 45 receiving the sampling output signal, clock pulses and security code and producing a frame synchronizing signal. The frame synchronizing circuit 45 as shown in FIG. 14, includes a decision circuit 451 in which a binary decision is made whether the level of the analogue sampling signal sampled by the clock pulse is above or below the threshold level of the circuit and a binary digital pulse train is outputted corresponding to the level of the sampling signal. The circuit 45 further includes a comparing circuit 452 which compares binary pulse train outputted from the decision circuit with the security code to produce a coincident signal when these are coincident. The circuit included in the circuit 45 is a circuit 453 for deciding the phases of the coincident signal outputted from the comparing circuit 452 and the clock pulses. An up-down counter 454 is for counting the output pulse of the phase decision circuit 453 also included in the frame synchronizing circuit 45. The circuit 45 is further provided with an AND circuit 455 in which the output signal of the up-down counter 454 and the coincident signal from the comparator 452 are logically multiplied to produce a frame synchronizing signal. The frame synchronizing signal is supplied to a phase matching circuit 462 of the code generator 46 where the security code from the security code memory 461 is phase synchronized to the frame synchronizing signal. The phase matching circuit 462 of the code generator 46 produces a security code S4 of which the phase is in phase with the frame synchronizing signal.

Figure 15:
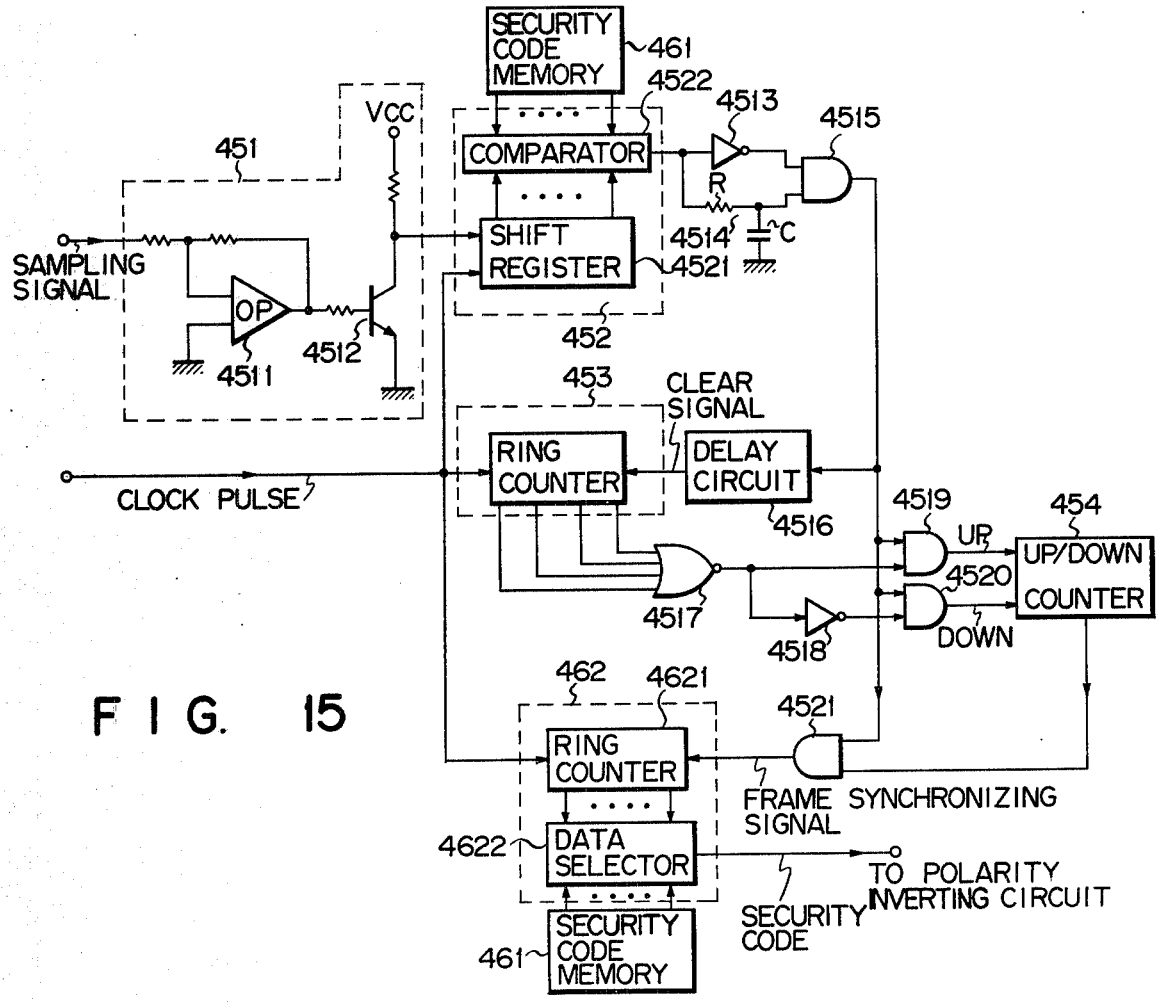
FIG. 15 shows a further detailed circuit of the synchronizing circuit shown in FIG. 14.

FIG. 15 is a concrete circuit diagram of the block circuit of FIG. 14. The decision circuit 451 includes an operational amplifier 4511 for amplifying the analogue sampling signal by a given amplitude and a transistor circuit 4512 which is connected with the operational amplifier and which is conductive when the output signal from the amplifier 4511 is above the threshold level of the transistor circuit while nonconductive when it is below the threshold level. In the decision circuit 451, the analogue pulse is converted into digital binary pulse. The output of the decision circuit 451 is supplied to the shift register 4521 of the comparator 452 in accordance with the clock pulses. The contents of the shift register 4521 and the contents of the security code memory 461 are compared in bit parallel in a comparator 4522 to produce a coincidence signal. The coincidence output of the comparator is applied through an inverter 4522 to an AND circuit 4515. The output of an integration circuit 4515 comprising R and C is applied to the AND circuit 4515. The output of the AND circuit 4515 is applied as a clear signal to the phase judgement circuit 453 through a delay circuit 4516. The phase judgement circuit 453 is comprised of a ring counter to check the phase coincidence between the clock pulse and the output signal of the comparator 452. The output signal of the ring counter 453 is applied to an AND circuit 4519 through an AND circuit 4517 while at the same time to an AND circuit 4520 through an inverter 4518. The AND circuit 4519 receives the coincident signal of the comparator 452 through AND circuit 4515 and, when the clock pulse and the output signal of the comparator 452 are in phase in the phase judgement circuit 433, AND circuit 4519 feeds the coincident signal as a count-up pulse, to the up-down counter 454. The AND circuit 4520 feeds the coincident signal of the comparator 452, when non-coincidence of phase is found in the circuit 453, to the up-down counter 454. At this time, the coincident signal is fed as a count-down signal to the counter 454. The output signal of the counter 454 and the output signal of the AND circuit 4515 are multiplied in the AND circuit 4521 to produce a frame synchronizing signal. The frame synchronizing signal is fed to the phase matching circuit 462. In the ring counter 4621, the phase of the frame synchronizing signal is checked with the clock pulse. The data selector 4622 selects necessary data through comparison of the contents of the ring counter 4621 with the security code from the security code memory 461. Accordingly, the data selector 4622 produces the security code synchronized. The security code S4 shown in FIG. 13(*c*) and the pulse signal shown in FIG. 13(*f*) are coincident at a relatively high probability. In this case, the error corresponds to the portion indicated by a dotted line. Therefore, in this synchronizing circuit 43, the binary pulses are decoded from the analogue sampling signal and the frame synchronization is made by using the decoded binary pulses , therefore ensuring a high precision of synchronization.

In the frame synchronizing circuit 45 shown in FIG. 14, the use of a differential decoding signal of the binary pulse decoding signal further improves the precision of the synchronization. The differential decoding signal is "0" when if the successive adjacent information are identical and is "1" when they are different. The differential decoding signal of the security code S4 shown in FIG. 13(*c*) is shown in FIG. 13(*d*). FIG. 13(*f*) shows a signal which is a binary expression of the binary pulse signal level shown in FIG. 13(*e*). FIG. 13(*g*) shows a differential decoded signal of FIG. 13(*f*). When the signals of FIG. 13(*c*) and FIG. 13(*g*) are compared, it will be seen that the number of errors are further lessened, being indicated by the dotted line.

Moreover, in the comparator 4522, it is not necessary to compare all frame codes. When the frame code is long, it may be allowed to compare only a part of frame codes. For example when the frame code length is more than a hundred bits, only the eight bits of the frame code may be compared. In this case it is good that the part of frame the code which may be compared, is unique pattern and different from another part of the frame code.

Various other modifications of the disclosed embodiments will become apparent to those skilled in the art without departing from the spirit and scope of the invention as defined by the appended claims.

What we claim is:

1. In a security communication system for transmitting a signal in a secret fashion comprising:

a transmitting unit including means for inverting the polarity of an original signal and a D.C. signal in accordance with predetermined codes; and a receiving unit including means for receiving the signal transmitted from the transmitting unit, means for inverting the polarity of the received signal in accordance with a predetermined code, and means for reproducing the received signal to the original signal by removing the D.C. signal component from the received signal;

the improvements wherein:

said transmitting unit comprises:

a sample-hold circuit coupled to receive said original signal for sampling and holding said original signal;

a first polarity inverting circuit coupled to said sample-hold circuit for inverting the polarity of the samples of said original signal in accordance with a first code;

an adder coupled to said first polarity inverting circuit for summing an output signal from said first polarity inverting circuit and a D.C. signal;

a second polarity inverting circuit coupled to said adder for inverting the polarity of the signal outputted from said adder in accordance with a second code; and means coupled to said second polarity inverting circuit for transmitting the signal outputted from said second polarity inverting circuit; and said receiving unit comprises:

means for receiving said transmitted signal;

a synchronizing circuit coupled to said receiving means for detecting a synchronizing signal component from the signal received from said transmitting unit and for establishing a synchronization between the transmitting and receiving units by using said synchronizing signal;

a third polarity inverting circuit coupled to said receiving means and to said synchronizing circuit for inverting the polarity of the received signal by using said synchronizating signal in accordance with said second code;

a D.C. signal component removing circuit coupled to said third polarity inverting circuit for removing said D.C. signal component from the output signal of said third polarity inverting circuit; and a fourth polarity inverting circuit coupled to said D.C. signal component removing circuit for inverting the polarity of the output signal outputted from said D.C. signal component removing circuit in accordance with said first code.

2. A security communication system according to claim 1, in which each of said first to fourth inverting circuits includes an inverting operational amplifier which inverts the received signal and amplifies it; and an analogue switch for selecting the received signal or the inverted signal from said amplifier in response to the logical level of a given code, said analogue switch permitting the received signal to pass therethrough when the given code is at a first logical level and permitting the inverted received signal from the inverting operation amplifier to pass therethrough when the given code is at a second logical level.

3. A security communication system according to claim 1, in which said D.C. signal component removing circuit comprises a high-pass filter for filtering the received signal, said high pass filter including a capacitor and a resistor connected between said capacitor and ground.

4. A security communication system according to claim 1, in which said synchronizing circuit comprises: a clock pulse detecting circuit including a phase locked loop circuit for detecting clock pulses with a given sampling frequency from the signal which is transmitted from said transmitting unit and received by said receiver; a sampling circuit for sampling said received signal by the clock pulses with a given sampling frequency; and a shift register for shifting an output signal from said sampling circuit by given bits, said shift register being coupled to said sampling circuit; and an AND circuit which is conditioned by the output of said sampling circuit and the output of said shift register to generate a frame synchronizing signal.

5. A security communication system according to claim 4, in which said synchronizing circuit establishes a synchronization between transmitting and receiving units in accordance with:

(a) detecting, by means of said clock pulse detecting circuit, clock pulses with a given sampling frequency from said received signal;

(b) sampling, by means of said sampling circuit, said received signal by the clock pulses;

(c) shifting said sampled received signal by given bits by means of said shift register;

(d) logically multiplying said sampled received signal shifted by given bits and said sampled received signal by means of a multiplying circuit; and (e) applying said frame synchronizing signal to means for inverting the polarity of said received signal by an inverting means which inverts the input signal thereto in accordance with a given code.

6. A security communication system according to claim 1, in which said synchronizing circuit comprises a clock pulse detecting circuit including a phase locked loop circuit for detecting clock pulses with a given sampling frequency from the received signal including a start pulse for synchronizing; a band-pass filter coupled to said synchronizing circuit for selecting the start pulse with a frequency of given times of that of the clock pulses from the received signal; a sampling circuit coupled to said band-pass filter for sampling the output signal of said band-pass filter by the clock pulses; a shift register coupled to said sampling circuit and for shifting by given bits the output signal of said sampling circuit; and an exclusive OR circuit having inputs coupled to said shift register and to said sampling circuit and in which the outputs of said shift register and said sampling circuit are exclusive-ORed to produce a frame synchronizing signal.

7. A security communication system according to claim 6, in which said synchronizing circuit establishes a synchronization between said transmitting and receiving units in accordance with:

(a) detecting, by means of said clock pulse detecting circuit, clock pulses with a given frequency from the received signal;

(b) selecting, by means of said band-pass filter, the start pulse from the received signal;
(c) sampling, by means of said sampling circuit, the start pulse by the clock pulses;
(d) shifting the sampled start pulse by given bits by means of said shift register;
(e) producing, by means of an exclusive-OR circuit, a frame synchronizing signal by exclusive-ORing the sampled pulses shifted by given bits and the sampled start pulse; and
(f) applying the frame synchronizing signal to means for inverting the polarity of the received signal in accordance with a given code.

8. A security communication system according to claim 1, in which said synchronizing circuit includes a clock pulse detecting circuit including a phase locked loop circuit for detecting clock pulses with a given sampling frequency from a received signal transmitted from said transmitting unit; means for sampling the received signal using said clock pulses; a decision circuit coupled to said received signal sampling means for determining whether the level of an analogue sampled signal obtained by sampling the received signal with the clock pulse is above or below a given threshold level of said decision circuit and for producing a binary digital pulse train corresponding to the level of said sampled received signal; a comparing circuit coupled to said decision circuit for comparing said binary pulse train outputted from said decision circuit with a security code signal and for producing a coincident signal when both said signals are coincident; and means coupled to said comparator for detecting the repetition frequency of said coincident signal generated by said comparator to reproduce a frame synchronization signal.

9. A security communication system according to claim 8, in which said decision circuit comprises: an operational amplifier coupled to said received signal sampling means for amplifying said analogue sampled signal by a given amplification rate; and a transistor switch circuit coupled to said operational amplifier and having a given threshold level, said transistor switch circuit being conductive when the signal outputted from said operational amplifier is above the threshold level of said transistor switch circuit and being non-conductive when it is below said threshold level.

10. A security communication system according to claim 8, in which said synchronizing circuit establishes a synchronization between said transmitting and receiving units in accordance with:
(a) sampling said analogue received signal by means of said received signal sampling means using the clock pulse;
(b) converting, by means of said decision circuit, the analogue sampled signal to the digital binary pulse;
(c) providing an exclusive-OR circuit for exclusive-ORing two continuous bit pulses of said digital binary pulses to obtain a differential decoding pulse;
(d) comparing said differential decoding pulse with the security code to produce a coincident signal when these are coincident;
(e) detecting, by said detecting means, the repetition frequency of the coincident signal to produce said frame synchronizing signal; and
(f) said frame synchronizing signal being coupled to said means for inverting the polarity of the received signal in accordance with the given code.

11. In a security communication system for transmitting a signal in a secret fashion comprising:
a transmitting unit including means for inverting the polarity of an original signal and a D.C. signal in accordance with predetermined codes; and
a receiving unit including means for receiving the signal transmitted from the transmitting unit, means for inverting the polarity of the received signal in accordance with a predetermined code, and means for reproducing the received signal to the original signal by removing the D.C. signal component from the received signal;
the improvements wherein:
said transmitting unit comprises:
a first polarity inverting circuit for inverting the polarity of said original signal in accordance with a first code;
a source of a D.C. signal;
a second polarity inverting circuit coupled to said D.C. source for inverting the polarity of said D.C. signal in accordance with a second code; an addition circuit coupled to said first and second polarity inverting circuits for adding the output signals outputted from said first and second polarity inverting circuits; and
means coupled to said adder for transmitting the signal added therein; and
said receiving unit comprises:
means for receiving said transmitted signal;
a synchronizing circuit coupled to said receiving means for detecting a synchronizing signal component from the signal received from said transmitting unit for synchronizing said receiving unit;
a third polarity inverting circuit coupled to said receiving means to to said synchronizing circuit for inverting the polarity of the received signal by using said synchronizing signal in accordance with said second code; a D.C. signal component removing circuit coupled to said third polarity inverting circuit for removing said D.C. signal component from the output signal from said third polarity inverting circuit; and
a fourth polarity inverting circuit coupled to said D.C. signal component removing circuit for inverting the polarity of the output signal fed from said D.C. signal component removing circuit in accordance with a third code which is a mod.2 addition of said first and second codes.

12. A security communication system according to claim 11, further comprising mod.2 addition means for mod.2 adding said first and second codes.

13. A security communication system according to claim 11, in which said first polarity inverting circuit inverts the polarity of the original signal in accordance with a third code which is a mod.2 addition of said first and second codes; and said fourth polarity inverting circuit inverts the polarity of the signal in accordance with said first code.

14. In a security communication system for transmitting a signal in a secret fashion comprising:
a transmitting unit including means for inverting the polarity of an original signal and a D.C. signal in accordance with predetermined codes; and
a receiving unit including means for receiving the signal transmitted from the transmitting unit, means for inverting the polarity of the received signal in accordance with a predetermined code, and means for reproducing the received signal to the original signal by removing the D.C. signal component from the received signal;

the improvements wherein:

said transmitting unit comprises:

a source of a D.C. signal;

a first polarity inverting circuit coupled to said D.C. signal source for inverting the polarity of said D.C. signal in accordance with a first code;

a sample-hold circuit coupled to receive said original signal for sampling and holding said original signal;

an addition circuit coupled to said first polarity inverting circuit and to said sample-hold circuit for summing a signal outputted from said first polarity inverting circuit and the sampled original signal;

a source of a second code;

a second polarity inverting circuit coupled to said addition circuit for inverting the output signal of said addition circuit in accordance with a third code which is a mod.2 addition of said first and second codes; and means coupled to said second polarity inverting circuit for transmitting the output signal outputted from said second polarity inverting circuit; and said receiving unit comprises:

means for receiving said transmitted signal;

a synchronizing circuit coupled to said receiving means for detecting a synchronizing signal component from the signal received from said transmitting unit and for establishing a synchronization between the transmitting and receiving units by using said synchronizing signal;

a third polarity inverting circuit coupled to said receiving means and to said synchronizing circuit for inverting the polarity of the received signal by using said synchronizing signal in accordance with said second code;

a D.C. signal component removing circuit coupled to said thir polarity inverting circuit for removing said D.C. signal component from the output signal of said third polarity inverting circuit; and a fourth polarity inverting circuit coupled to said D.C. signal component removing circuit for inverting the polarity of the output signal outputted from said D.C. signal component removing circuit in accordance with said first code.

15. A security communication system according to claim 14, further comprising mod.2 addition means for mod.2 adding said first and second codes.

* * * * *

UNITED STATES PATENT AND TRADEMARK OFFICE

CERTIFICATE OF CORRECTION

PATENT NO. : 4,159,399

DATED : June 26, 1979

INVENTOR(S) : Shigeru ASAKAWA et al

It is certified that error appears in the above-identified patent and that said Letters Patent are hereby corrected as shown below:

Column 7, lines 64 and 65, change "superposed signal" to --superposed D.C. signal--;
line 65, change "in the polarity" to --in polarity--;

Column 8, line 60, change "signal process processing" to --signal processing--;

Column 9, lines 6 and 7, "stationary signal" should read -- D.C. signal --;

Column 10, line 38, after "in order to" insert --achieve--;

Column 11, line 45, after "counter 454" delete "is"; change "pulse" to --pulses--;
line 46, after "circuit 453" insert --is--.

UNITED STATES PATENT AND TRADEMARK OFFICE

CERTIFICATE OF CORRECTION

PATENT NO. : 4,159,399

DATED : June 26, 1979

INVENTOR(S) : Shigeru ASAKAWA et al

It is certified that error appears in the above-identified patent and that said Letters Patent are hereby corrected as shown below:

Column 18, line 17, change "thir" to --third--.

Signed and Sealed this

*Eleventh* Day of *December 1979*

[SEAL]

*Attest:*

SIDNEY A. DIAMOND

*Attesting Officer* *Commissioner of Patents and Trademarks*